United States Patent [19]

Fitzpatrick

[11] 4,248,711

[45] Feb. 3, 1981

[54] BASEMENT FLOOR DRAIN AND INTEGRAL TRAP

[76] Inventor: Thomas L. Fitzpatrick, 50 Nightingale Ave., Massena, N.Y. 13662

[21] Appl. No.: 155,430

[22] Filed: Jun. 2, 1980

[51] Int. Cl.[3] ..... F03F 5/06

[52] U.S. Cl. ..... 210/163; 137/247.27; 137/247.45; 137/602

[58] Field of Search ..... 137/247.27, 247.43, 137/247.45, 247.47, 602; 210/163, 164, 235 R

[56] References Cited

U.S. PATENT DOCUMENTS

| | | | |
|---|---|---|---|
| 871,836 | 11/1907 | Wade | 137/247.27 |
| 1,593,083 | 7/1926 | Kirchhan | 1376/247.27 X |
| 2,938,437 | 5/1960 | Daley | 137/247.27 X |
| 3,042,210 | 7/1962 | Hattori | 210/163 |
| 3,066,802 | 12/1962 | Loffler | 210/163 |

FOREIGN PATENT DOCUMENTS

| | | | |
|---|---|---|---|
| 169289 | 8/1934 | Switzerland | 137/247.27 |

*Primary Examiner*—Harold W. Weakley
*Attorney, Agent, or Firm*—Ross, Ross & Flavin

[57] ABSTRACT

A drain/trap to be installed in a basement flooring comprises an assembly cast in metal or molded from a corrosion-resistant synthetic resin includes an upwardly open housing of generally tubular outline, a secondary circuit leading through the bottom wall of the housing and having an inboard extremity opening into the housing interior, and a connecting conduit having a bottom inlet and a lateral outlet communicating with the housing and a lid for the housing. The secondary conduit leading from the ground area beneath the flooring allows the percolation of waters therefrom into the housing for mixture with the drainage waters therein. The trap is of generally U shaped configuration and the inlet end of the secondary conduit is disposed at a fluid level higher than that of the main drain conduit.

3 Claims, 4 Drawing Figures

BASEMENT FLOOR DRAIN AND INTEGRAL TRAP

Figure 1:
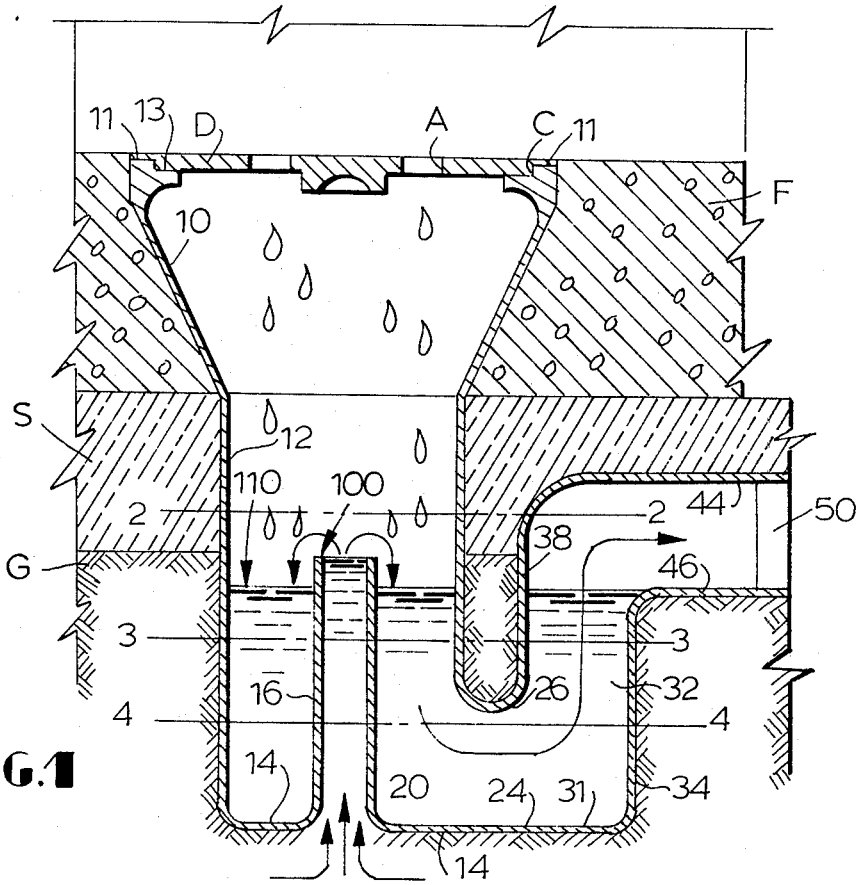

The present invention relates generally to new and useful improvements and structural refinements in a unitary basement floor drain and trap and is directed more particularly to the provision of a floor drain having general utility in the arts, and to an improvement in the means for offsetting the common water conditions encountered with rain water, melting snow, springs, lack of drainage, etc.

The assembly is for the drain of waste water from a basement flooring and of drainage waters accumulated in the soil under that flooring and facilitates the conduct of the mixed waters to a connecting sewer or other disposal means.

It will be helpful to an understanding of my invention first to briefly consider some of the essential points and more important features and aspects thereof, so that same may be kept in mind during subsequent reading of the detailed description of the practical embodiment of my improvement and illustration thereof in the hereunto annexed drawing.

It is first to be noted that the invention may be embodied in any device incorporating a drain for use on a basement or cellar floor where water may be expected to seep into the basement through the vertical side walls or upwardly through the flooring from the soil below.

Without intending to place undue limitations upon the scope of the invention beyond what may be required by the state of the prior art, the particular embodiment may be briefly described as embracing the concept of a floor drain complete with strainer flush with the basement floor and a trap integral therewith and including a vertically-disposed percolator or spouting tube extendable into the bowl through the drain bottom wall and being fluidically connected to the ground area below the bowl for the passage of water upwardly through the spouting tube and therefrom into the bowl interior for admixture thereat with any drained water from the basement interior and along the flooring thereof.

The outboard terminal of the percolator or spouting tube is flush with the drain bottom wall and the inboard terminal interiorly of the bowl in a horizontal plane slightly above the lower level of the trap outlet invert.

The invention comprehends a particular construction, arrangement, combination, and relationship of the various elements, components and instrumentalities of a basement floor drain and cooperant trap directly associated therewith as exemplified in the following detailed disclosure wherein the objects hereof will be apparent.

One general object hereof is to provide a system whereby, when the ground water level rises above the top of the spouting tube, it will overflow into the bowl and therefrom outwardly through a trap outlet, in manner such as to lower the water level to a point below the floor slab and the next adjacent soil stratum therebelow.

More particularly stated, the dewatered slab and next adjacent soil stratum will then dehydrate, thereby reducing the humidity within the basement, reduce the amount of floor paint spauling, and increase the R factor so as to reduce the heat loss from the basement to the soil below, all in one way or another conserving energy.

One of the subsidiary objects of the invention is, accordingly, the achievement of these satisfactory results by the use of a simple system of the type above indicated.

An advantageous embodiment of the invention is in connection with the fact that it can be made unitary as a single unit or it can be made in separate parts, as preferred.

In another advantageous embodiment, according to the invention, it is conceivable that the vertical height can be varied so as to accommodate to a variety of encountered local conditions.

In addition to the practical advantages which I herein ascribe to my novel arrangement, another chief feature resides in the fact that the system allows the basement flooring to be maintained in a dry condition so as to remove therefrom the recognizable dank odors so commonly associated with basements.

Another object is to provide an arrangement of the above mentioned type that permits of long continued use with a minimum of need for repair or maintenance on the part of the user, all resulting in important distinct advantages in economy of manufacture, ease of operation, reliability of performance, and capability of ready assembly to provide positiveness and ease of manual control and action under the varying conditions of practical use.

To make the manufacture of the assemblage a more profitable undertaking, the mechanism embodying the essence of the invention has been engineered in manner as to be simple in its construction so as to expedite economical production and assembly, the usual complexity of components having been reduced so as to offer a compact design representative of a fundamentally new concept in the combining and coacting of operating parts.

Further, while the components are uniquely compact, they are nevertheless readily accessible for maintenance and replacement purposes with a consequent reduction in maintenance costs over related devices heretofore known.

As a further refinement of the present invention, I provide a structure wherein the unique features of design are inconspicuous and non-observable by the average eye so that the average user is not made aware thereof.

Another important object hereof is the provision of an improved construction capable of being formed in a very inexpensive manner and requiring a minimum number of tools or molds for its production, with the structure being such as to permit rapid quantity manufacture.

Other of the chief objects and purposes hereof are to provide advantageous structural and operational features in a device of the class to which reference has been made so as to offer an apparatus having the following inherent meritorious characteristics; first, engineering-wise, a uniqueness in design of coacting parts wherefor the components are coordinated for facile assembly; second, a susceptibility to easy installation; third, a high degree of safety in its use; fourth, a high degree of efficiency and dependability in its operational use; fifth, the securement of a higher degree of accuracy and greater degree of variety in the manner of work performed therewith than has heretofore been possible with prior devices known in the art; and sixth, the provision of such other improvements in and relating to drains of the type above referred to as are hereinafter described and claimed.

It will be apparent, however, that the physical embodiment delineated, albeit the preferred exemplification, is only indicative of but one of the multiplicity of ways in and purposes for which the principles of the invention may be employed. Same is submitted as a best known embodiment of the invention in accordance with the patent statutes and is given with a view to illustrating and explaining the precise nature of the principles of the invention and their embodiment for practical use, in order that others skilled in the art to which the invention pertains may be enabled to adapt and modify them in numerous variations and modifications, each as may be best adapted to the conditions of any particular use.

The invention reverted to is not restricted or confined to said embodiment and same is not intended to be exhaustive of, nor limiting of, the spirit or scope hereof. That is, the precise construction of the figures of the drawing need not be slavishly followed as, of course, the drain may have to be adapted or alternatively constructed or modified in accordance with any specific use contemplated therefor, there being no intent to have this invention limited to or circumscribed by any specific details.

While all of these objects are attainable in the preferred and disclosed embodiment, it is to be understood that, by utilizing the invention only in certain of its aspects, certain of the objects may be attained individually or in sub-groups without necessarily attaining all of the objects. That is, while the advantages of the invention as here outlined are best realized when all of its features and instrumentalities are combined, useful embodiments may be produced involving less than the whole.

Figure 2:
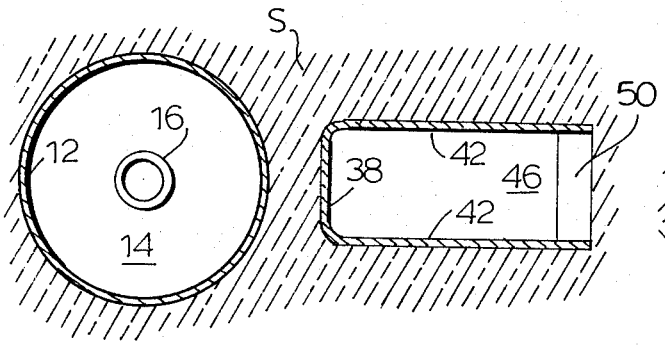
Figure 3:
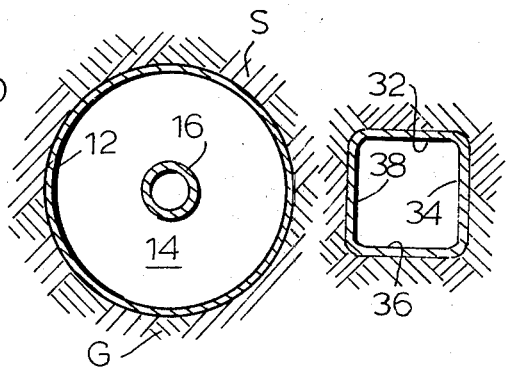
Figure 4:
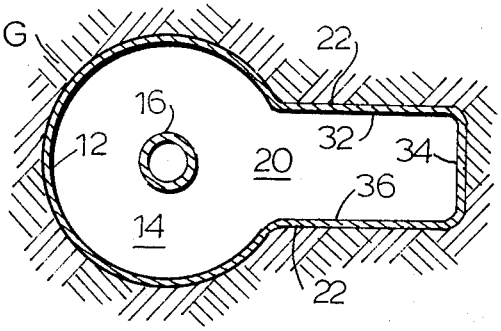

The characteristic features which I consider to be novel with the invention, as to its construction and organization, will be better understood from a consideration of the following detailed description forming a part of this specification, when read in conjunction with the illustrations in the accompanying drawing and in which:

FIG. 1 is a sectional view through a basement flooring and the next two adjacent strata of soil therebelow and the combination floor drain and trap of the invention associated therewith; and FIGS. 2, 3 and 4 are views in plan taken on the lines 2—2, 3—3, and 4—4 respectively.

In the following description, various components and details thereof will be identified by specific names for purposes of convenience. Although specific terms and expressions are employed for purposes of identifying various components, they are used in a generic and descriptive sense only. The phraseology or terminology herein employed is not for the purpose of limitation and the terms are intended to be as generic in application as the art will permit. They are not intended to exclude any reasonable equivalents of the features shown and described or portions thereof.

With continued reference now to the drawing, which illustrates a typical and preferred embodiment of the invention for the purpose of disclosure and forms a part of this speicification, I have shown a basement floor F formed of cement or equivalent resting upon a sub-surface or first stratum of soil S which in turn may rest upon a second layer or stratum of soil L.

As is conventional with floor drains, they are placed in the concrete floor of a basement, for example, in the home and usually near a clothes washer or like applicance which needs to drain into the floor drain.

The trap per se is comprised of a first annular wall 10 having a downwardly and inwardly tapering or cone-like configuration and having its uppermost annular rim 11 suitably seated in flooring F so as to extend therethrough, the flooring being preferentially poured after the trap has been placed in situ or the finished flooring being modified by the provision of an opening therethrough for acceptance of the trap therethrough and pouring of fresh cement therearound thus completing its encapsulation.

A circular flat drain or strainer plate D having apertures A may be nestably received on the shoulder 13 of a strategically-located central opening C at the top of the housing for the acceptance therethrough of waters draining from the basement flooring. Opening C serves as the primary inlet to the housing interior.

Integral with or separable from annular wall 10 is a second straight-sided vertically-extending annular wall 12 in fluidic communication with annular wall 10, such annular wall being extended downwardly of flooring F and through soil strata S and L therebelow to the appropriate depth. As aforesaid, annular wall 12 may be made of varying heights to accommodate to different operating conditions, particularly where water drainage capacities of greater or lesser degree are needed.

Such annular wall 12 connects with a horizontal bottom wall 14 through which an annular percolator 16 extends upwardly into and centrally of the bowl area defined within annular wall 12.

The percolator serves as a secondary inlet conduit which is fluid connected to the bowl intermediate the top and bottom of the housing and with a fluid level 100 above the fluid level 110 of what will be described as the main trap conduit.

The percolator is disposed centrally of the housing so that draining therefrom will be radial in the sense that it will be to all sides thereof so as to allow optimum mixture with the drainage water contained therewithin and received from the basement floor via opening C.

The percolator allows communication from the exterior soil area beneath and adjacent bottom wall 14 and allows the percolating of fluids therefrom upwardly therethrough.

The secondary inlet conduit or percolator has a longitudinal axis which enters the bowl on an axis which is centrally disposed as viewed in plan so as to allow a gently dribbling effect of the fluid leaving the secondary conduit as it enters the bowl.

The main trap conduit will now be described.

The lower portion of annular wall 14 at one side thereof is interrupted by a horizontally-extending communicating passageway 20 defined by a pair of spaced vertical side walls 22 and 22, a bottom wall 24 in the form of an extension of bottom wall 16, and a top wall 26 in the form of an angular extension of annular wall 12, the four walls cooperantly defining the inboard portion of a trap outlet invert.

Forming the intermediate portion of the trap outlet invert is a boxlike four sided wall arrangement comprising walls 32, 34, 36 and 38. Wall 38 communicates with and merges upwardly from wall 26, walls 32 and 36 merge with and extend upwardly from wall 31 which is an extension of wall 24, and wall 34 likewise merges with and extends upwardly from wall 31.

Forming the outboard portion of the trap outlet invert is a generally horizontally extending box-like four-sided wall arrangement comprising spaced vertical side walls 42, each merging from and connected integrally to a respective side wall 32 or 36, a top wall 44 merging from and connected to wall 38, and a bottom wall merging from and connected to wall 34.

A further extension pipe generally indicated by 50 may be fluidically connected to the outlet end of the so-called outboard portion for the drainage therefrom of any excess waters collecting therewithin.

Water from the basement flooring is allowed to drain through the drain D in the usual known manner so as to be allowed to settle within the bowl in the usual known manner until allowed to drain off via outlet 50 in the usual known manner.

It will be noted that the discharge level of the secondary conduit is higher then the lower level of the main discharge conduit so that the trap functions for both drainage water passing thereinto from the basement flooring and from the soil beneath that flooring.

Other waters in the subterranean ground area adjacent the walled area of the structure, that is adjacent the vertical side walls (not shown) and below the flooring, are allowed to percolate into the drain interior via the percolator. The waters, under the effects of the relief of any inherent pressures, by virtue of the strategic locating of the percolator, are allowed to rise upwardly through and outwardly of the tube and thence downwardly into the drain interior once having passed therethrough. They fall downwardly only to be collected in the bowl in the usual manner along with the other collected waters and therewith to be drained outwardly through the invert.

It is believed that the gist of the invention will be clearly understood from the foregoing disclosure and accordingly, further analysis thereof at this point is considered unnecessary, as I have, in accordance with the provisions of the patent statutes, described the construction and principle of operation of my invention together with the apparatus which I believe to represent the best embodiment thereof, to the end that others can, by applying current knowledge, readily adapt it for various applications without omitting features which, from the standpoint of prior art, fiarly constitute essential characteristics of its generic and/or specific aspects. The substitution of equivalents and other changes, modifications and alterations as circumstances may suggest or render expedient, are reasonably contemplated, the invention being susceptible of such without departing from its real spirit or underlying principles.

The claims are desired to include within the scope thereof all of said suitable variations, modifications and equivalents by which substantially the results of the invention may be obtained through the use of substantially the same or equivalent devices or means. Accordingly, limitation hereof should only be made as determined by a proper interpretation of the prior art and the scope of the subjoined claims, in which it is my intention to claim all novelty inherent herein as broadly as possible.

I claim:

1. In a drain for a basement floor having a circular bowl portion, a strainer plate covering the bowl portion, a U-shaped main trap conduit positioned below the bowl portion and fluidically connected at one end to the bowl portion and leading from the other end to a discharge outlet, the improvement comprising a secondary inlet conduit fluidically connected to the bowl portion and leading through the bowl from the exterior ground area in which the arrangement is seated beneath the floor, the secondary inlet conduit having a discharge end disposed above the fluid level of the main trap conduit.

2. In the floor drain as defined in claim 1, and further wherein the secondary inlet conduit is integral with the bowl portion.

3. In the floor drain as defined in claim 1, and further wherein the secondary inlet conduit has a longitudinal axis which is normal to the longitudinal axis of the main drain conduit.

* * * * *